US006567721B1

(12) United States Patent
Endo

(10) Patent No.: US 6,567,721 B1
(45) Date of Patent: May 20, 2003

(54) AUTOMATIC SEWING MACHINE CONTROLLER

(75) Inventor: Yasuhiro Endo, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/806,255

(22) PCT Filed: Apr. 2, 1999

(86) PCT No.: PCT/JP99/01738

§ 371 (c)(1),
(2), (4) Date: Mar. 28, 2001

(87) PCT Pub. No.: WO00/60156

PCT Pub. Date: Oct. 12, 2000

(51) Int. Cl.[7] ..... G06F 19/00; D05B 21/00
(52) U.S. Cl. ..... 700/138; 112/102.5; 112/470.06
(58) Field of Search ..... 700/138, 136, 700/137; 112/102.5, 470.06, 470.04, 457

(56) References Cited

U.S. PATENT DOCUMENTS 4,403,559 A * 9/1983 Hirose ..... 112/470.04
4,506,612 A * 3/1985 Yanagi ..... 112/102.5
5,934,209 A * 8/1999 Mizuno ..... 112/102.5

FOREIGN PATENT DOCUMENTS

CN 1115809 A 1/1996
DE 4431318 C2 3/1996
DE 19712421 C1 3/1997
JP 5-5262 1/1993 ..... D05C/5/06
JP 6-246077 9/1994 ..... D05B/21/00
JP 10-137467 5/1998 ..... D05B/19/08
JP 2838710 10/1998 ..... D05B/21/00

OTHER PUBLICATIONS

OFFICIAL ACTION of the German Patent and Trademark Office dated Nov. 8, 2002 with an English translation.

* cited by examiner

*Primary Examiner*—Peter Nerbun
(74) *Attorney, Agent, or Firm*—Sughrue Mion, PLLC

(57) ABSTRACT

An automatic sewing machine control apparatus having a machine needle 8 which is interlocked with a motor for use in sewing cloth 12, a biaxial driving mechanism 20 allowing a cloth hold-down portion 10 to be manually moved in both X- and Y-axis directions perpendicularly intersecting each other, encoders 224 and 226 for detecting the rotational angles of an X- and a Y-axis motor 124 and 126 for driving the biaxial driving mechanism 20, X and Y coordinate value computing means for obtaining the values of coordinates X and Y from the origin of the biaxial driving mechanism 20 according to the values detected by the encoders 224 and 226, RAM for storing the values of coordinates X and Y obtained by the X and Y coordinate computing means by manually moving the biaxial driving mechanism 20 to at least one of predetermined positions of the machine needle, and forming means for forming a seam pattern in a predetermined position corresponding to the kind of the seam received from a group of sewing condition setting keys 56.

1 Claim, 11 Drawing Sheets

AUTOMATIC SEWING MACHINE CONTROLLER

TECHNICAL FIELD

This invention relates to an automatic sewing machine control apparatus for forming seams by driving and controlling a cloth holding down portion for use in clamping an article to be sewn.

BACKGROUND ART

In order to stitch desired sewing patterns using industrial sewing machines, sewing data corresponding to the sewing patterns is prepared and information for driving the sewing machines in accordance with the order of performing sewing operations is held in storage media such as floppy disks. While cloth as an article to be sewn is press-clamped according to the sewing data (information on sewing methods), a predetermined sewing pattern is automatically stitched by moving the cloth on a predetermined plane.

The sewing data includes a relative position displacement quantity between a machine needle per stitch for forming the sewing pattern and the cloth, and control commands for controlling the sewing machine and a motor for driving the machine. The sewing data on one sewing pattern is formed as a collection of data per stitch.

A conventional automatic sewing machine will be described with reference to FIGS. 7 and 8. In FIGS. 7 and 8, an automatic sewing machine 1 comprises an interlocking motor 2 for vertically operating a machine needle 8 via a belt 4, a cloth hold-down portion 10 for use in clamping cloth 12 as an article to be sewn mounted on a machine table 1*a*, a switchgear 18 such as a cylinder, for example, for opening and closing the cloth hold-down portion 10 used for attaching and detaching the cloth 12, and a biaxial driving mechanism 20 for moving the cloth 12 in the two axial directions X and Y together with the cloth hold-down portion 10.

The biaxial driving mechanism 20 has an origin detector 21 for detecting the mechanical origin of the cloth hold-down portion 10 and is so arranged as to be moved in two axial directions of X and Y as an X- and a Y-axis motor 24 and 26 each having stepping motors are driven, the sprockets of the respective X- and Y-axis motors 24 and 26 being put on a belt.

A control portion 30 includes CPU 32 for use in controlling cloth feeding as well as the motor speed in the sewing machine, ROM 34 for storing a procedure for executing the system of the CPU 32, RAM 36 for storing the sewing data prepared in an operating portion 50, a driving portion 40 for driving motors, and an interface 42 for electrically connecting the origin detector 21 and the operating portion 60.

The operating portion 50 includes numeric keys 52 for inputting lengths of sewing seams, a group of setting keys 54 for designating a sewing start point and the like, a group of sewing condition setting keys 56 as kinds-of-seams inputting means for inputting idle feeding and kinds of seams such as linear, arcuate, circular seams and the like, and inching keys 58 for inching the cloth hold-down portion 10 on the X- and Y-axis, including an X-axis and a Y-axis inching key for inching the biaxial driving mechanism 20 on the X- and Y-axis. Further, the operating portion 50 has a coordinate operating portion for obtaining X and Y coordinate values by increasing and decreasing the number of pulses from the inching keys, and a display portion 60 formed of a liquid crystal display for displaying the X- and Y-axis coordinate values.

The operation of the automatic sewing machine thus arranged will be described with reference to FIGS. 7 to 11. In a case where pocket cloth 13 as a sewing object is sewn to the cloth 12 so as to attain A→B→C→D→E sewing points from the origin by idle feedings shown in FIG. 9, there follow the steps of operating the X-Y driving mechanism 20 as shown in FIG. 10 via the driving portion 40 to generate pulse commands by depressing the X- and Y-axis inching ±keys, making the coordinate operating portion compute the coordinate values of Xa and Ya at the point A according to the pulse command by moving the machine needle 8 from the origin to the position of the point A, and storing the coordinate values in the RAM 36 by depressing the setting key.

Similarly, there also follow the steps of, as shown in FIG. 10, operating the X-Y driving mechanism 20 by depressing the X- and Y-axis inching keys to operate the X-Y driving mechanism 20 to position the machine needle 8 at the point B, depressing the setting key and the linear sewing key to store the coordinate values of Xb and Yb and the kind of sewing in the RAM 36, then positioning the machine needle 8 at the point C, and depressing the setting key and the linear sewing key to store the coordinate values of Xc and Yc and the kind of sewing in the RAM 36. The coordinate values at the points D and E are stored in the RAM 36 likewise.

As the automatic sewing machine control apparatus has thus been arranged, the sewing patterns have been stored in the RAM 36 with the operator's operation of the biaxial driving mechanism 20 to actuate the X and Y motors 8 and 9 by depressing the X- and Y-axis inching keys and the like when sewing data is newly input to and stored in the RAM 36. However, it is impossible for the biaxial driving mechanism 20 to move quickly as the X and Y motors 8 and 9 only operate intermittently, which necessitates a great deal of time to prepare the sewing pattern data. In particular, when a large amount of data is input, a large amount of time is necessary for processing the data.

As the automatic sewing machine control apparatus has thus been arranged, the sewing patterns have been stored in the RAM 36 with the operator's operation of the biaxial driving mechanism 20 to actuate the X and Y motors 8 and 9 by depressing the X- and Y-axis inching keys and the like when sewing data is newly input to and stored in the RAM 36. However, it is impossible for the biaxial driving mechanism 20 to move quickly as the X and Y motors 8 and 9 only operate intermittently, which necessitates a great deal of time to prepare the sewing pattern data. Particularly when a large amount of data is input, there has developed a problem from causing a good long time therefor to be taken.

In view of the above problems, it is therefore an object of the present invention to provide an automatic sewing machine control apparatus which reduces the work of arranging an article to be sewn.

DISCLOSURE OF THE INVENTION

An object of the present invention made to solve the foregoing problems is to provide an automatic sewing machine control apparatus which is intended to reduce the work of arranging an article to be sewn.

In order to accomplish the object above, an automatic sewing machine control apparatus in the first aspect of the invention comprises: kinds-of-seams inputting means for inputting idle feeding and kinds of seams such as linear, arcuate, circular seams and the like corresponding to the seam pattern of an article to be sewn, a cloth hold-down portion for clamping the article, a machine needle which is interlocked with a driving motor for use in sewing the article, a biaxial driving mechanism allowing the cloth hold-down portion to be manually moved in both X- and Y-axis directions perpendicularly intersecting each other, an X- and a Y-axis motor for driving the biaxial driving mechanism, rotational angle detection means for detecting the rotational angles of the X- and Y-axis motors, X and Y coordinate value computing means for obtaining the coordinate values of X and Y from the origin of the biaxial driving mechanism according to the values detected by the rotational angle detection means, storage means for storing the X and Y coordinate values obtained by the X and Y coordinate computing means by manually moving the biaxial driving mechanism to at least more than one predetermined position of the machine needle, and forming means for receiving the predetermined position thereof and forming a seam pattern corresponding to the kind of the seam received from the kinds-of-seams inputting means.

An automatic sewing machine control apparatus in the second aspect of the invention comprises: storage means for storing the values of at least two of the reference coordinates, a cloth hold-down portion for clamping a sewing line beforehand or a sewing article to be sewn displaying at least two points forming the sewing line, a machine needle which is interlocked with a driving motor for use in sewing the article, a biaxial driving mechanism allowing the cloth hold-down portion to be moved in both X- and Y-axis directions perpendicularly intersecting each other, an X- and a Y-axis motor for driving the biaxial driving mechanism, rotational angle detection means for detecting the rotational angles of the X- and Y-axis motors, X- and Y-axis coordinate value computing means, means for computing the values of tilting X- and Y-coordinates of the start and designate points on the basis of the rotational angles detected by the rotational angle detection means by moving the biaxial driving mechanism between at least two any given sewing line of the sewing article clamped by the cloth hold-down portion or otherwise moving the biaxial driving mechanism in between the two points of the sewing article, means for computing the tilting values obtained from the of the X- and Y-coordinates, and modifying means for modifying the tilting of the sewing pattern according the value obtained from the tilting computing means.

An automatic sewing machine control apparatus in the third aspect of the invention in addition to the second aspect thereof includes storage means which has been stored with sewable coordinates showing an area where sewing is possible, and decision means for deciding whether or not each of the modified coordinates of the sewing pattern generated by the modifying means is within the sewable coordinate values.

BEST MODE FOR CARRYING OUT THE INVENTION

Embodiments of the invention will now be described as follows:

Embodiment 1

Figure 1:
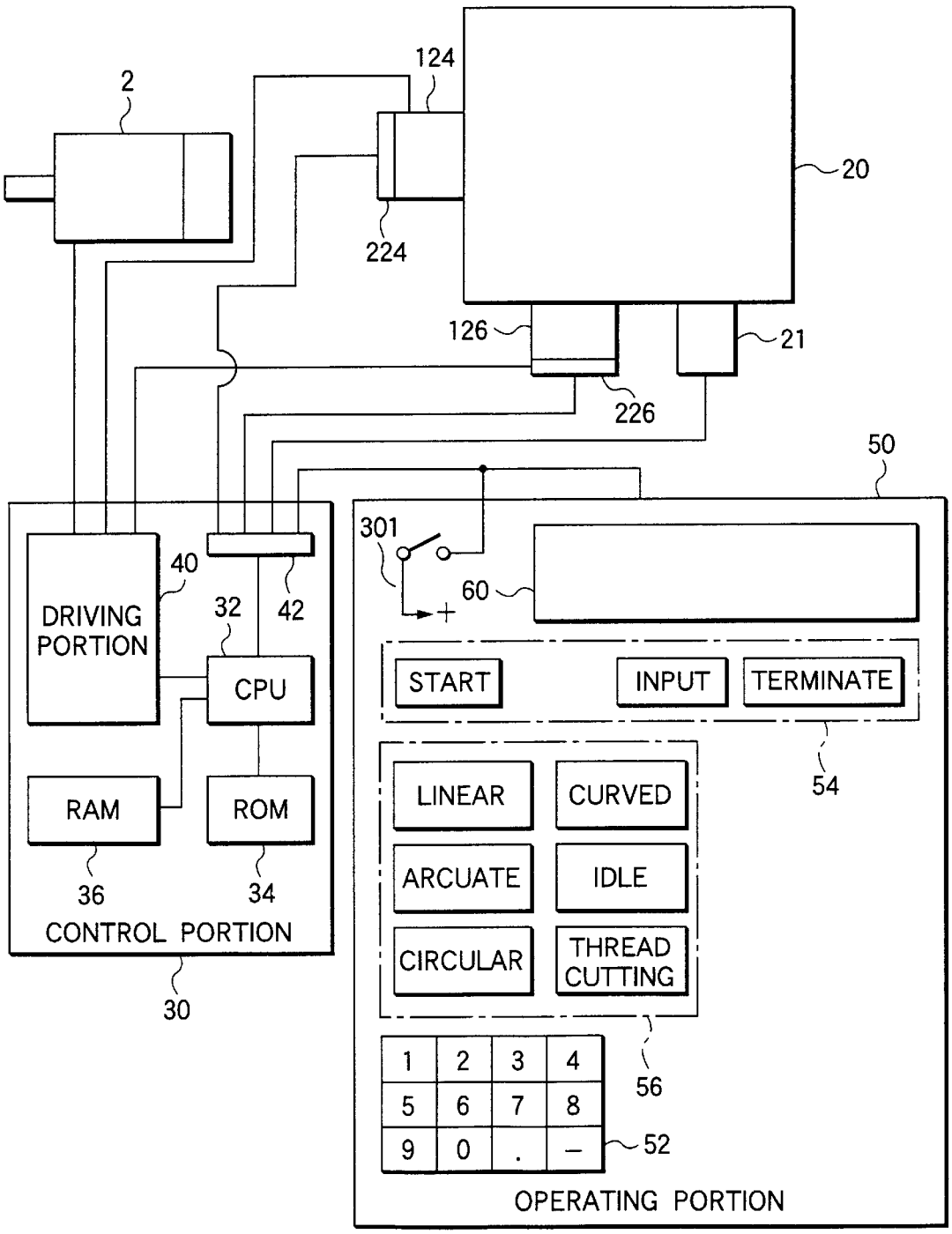
FIG. 1 is a block diagram of an overall automatic sewing machine control apparatus embodying the present invention.

Referring to FIG. 1, there is shown a block diagram of an embodiment of the invention. FIG. 1 is a block diagram of an overall automatic sewing machine control apparatus embodying the invention; though like reference characters shown therein designate like parts and the description thereof will be omitted. As shown in FIG. 1, inching keys 58 that have conventionally been provided in the display portion 60 are omitted and otherwise a start switch 301 for turning off the driving portion 40 and turning on a control portion 30 other than the driving portion 40 is additionally provided. The sewing machine also has three-phase induction motors for actuating X- and Y-axis driving mechanism 20 including an X- and a Y-axis motors 124 and 126, encoders 224 and 226 as means for detecting the respective rotational angles of the X- and Y-axis motors and also generating the predetermined number of pulses corresponding to the rotational angles thereof. The control portion 30 is provided with X- and Y-coordinate computing means (CPU 32 and ROM 34) for computing X- and Y-coordinate values of a machine needle 8 with respect to a cloth hold-down portion 10 by increasing and decreasing the number of pulses of encoders 224 and 226.

Figure 2:
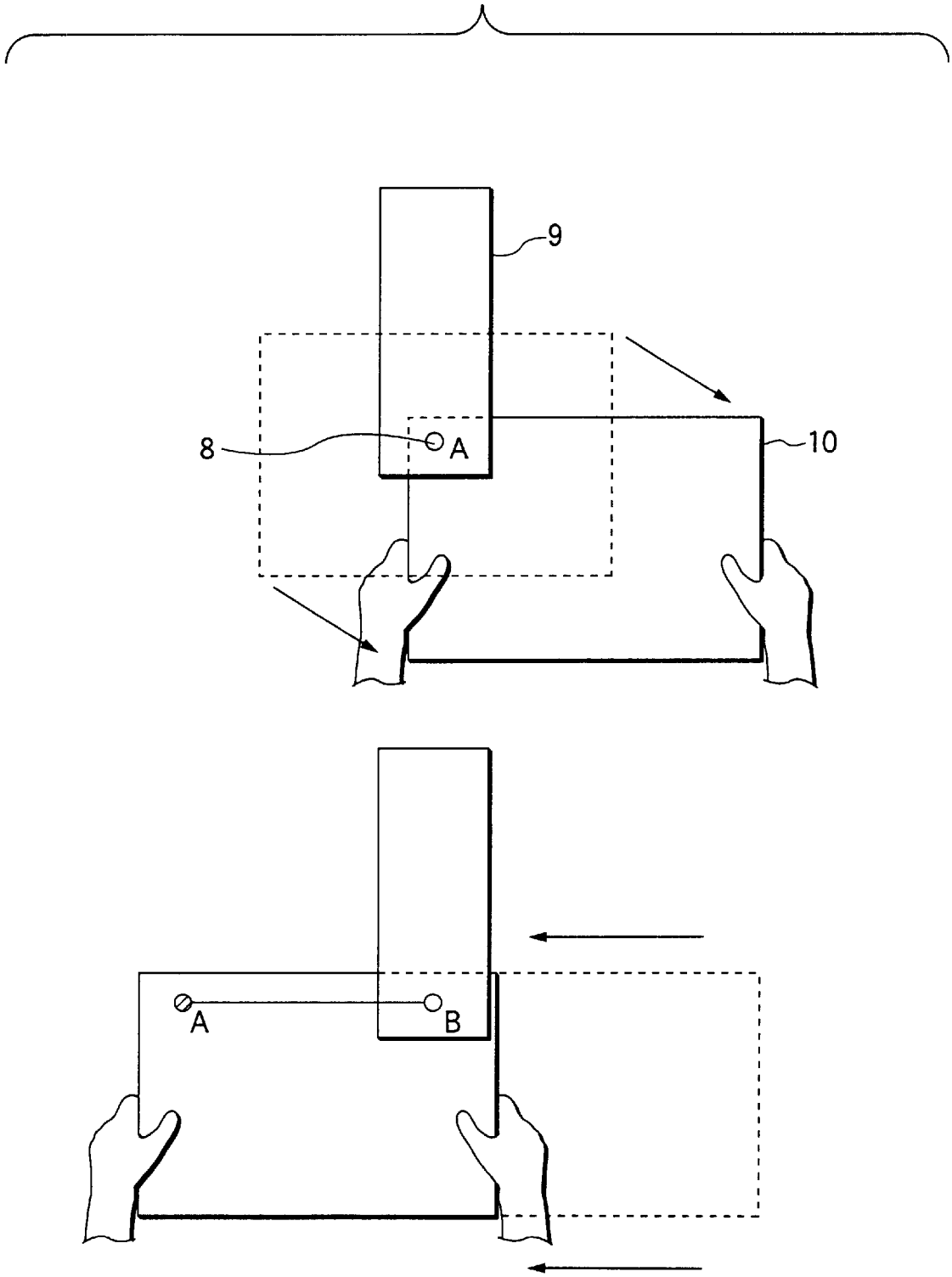
FIG. 2 is a plan view of a cloth hold-down portion of the automatic sewing machine control apparatus shown in FIG. 1, while the cloth hold-down portion is being manually moved.
Figure 3:
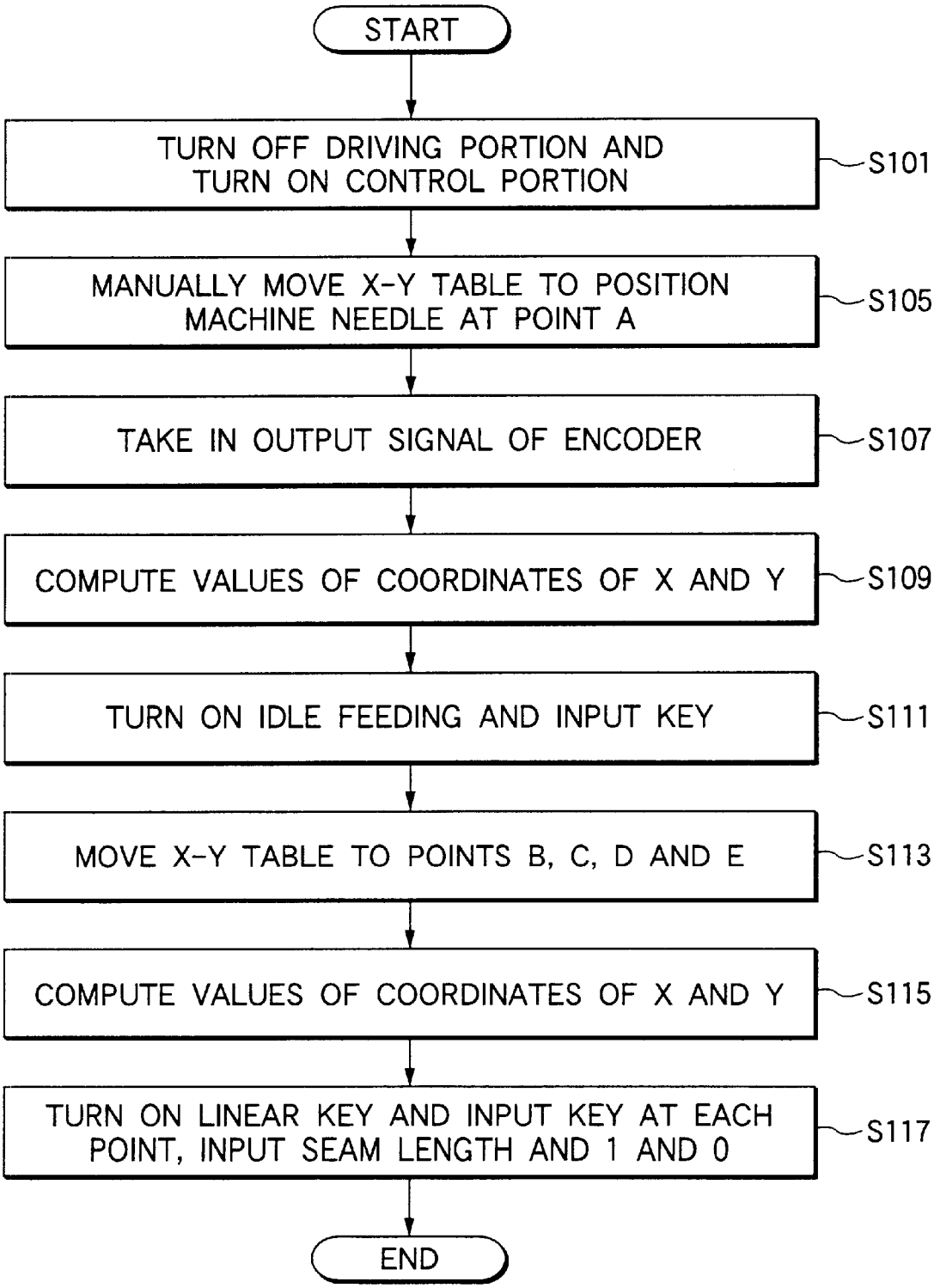
FIG. 3 is a flowchart showing the operation of the automatic sewing machine control apparatus shown FIGS. 1 and 2.
Figure 9:
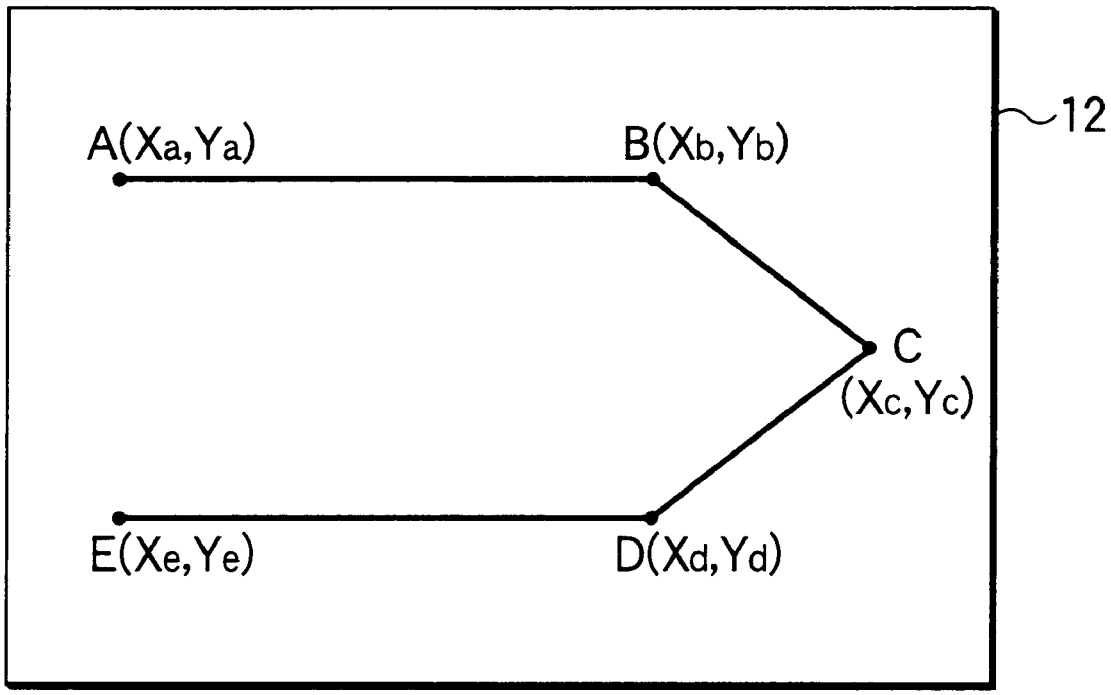
FIG. 9 is a plan view of a sewing chart that is applied to cloth.
Figure 10:
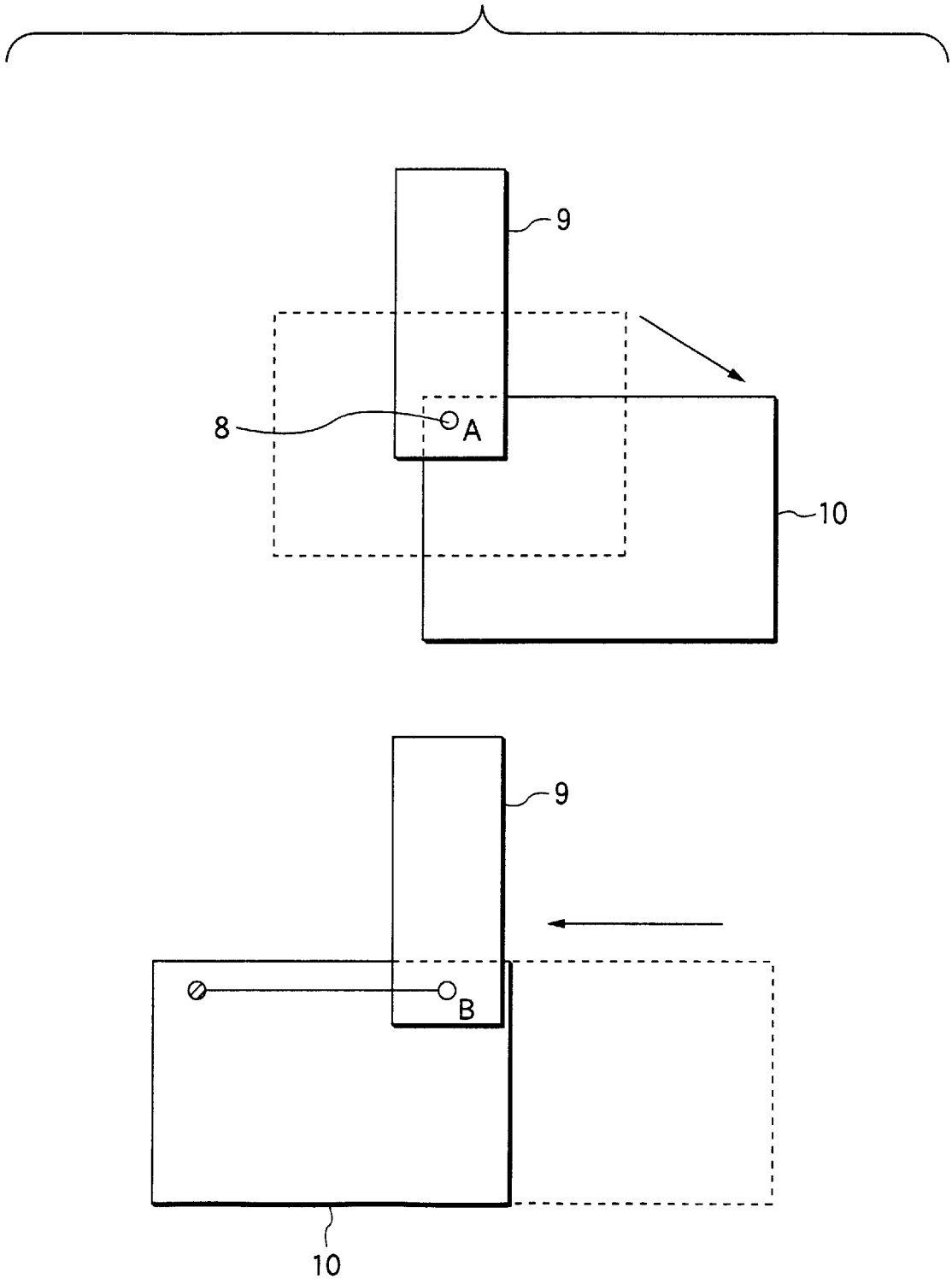
FIG. 10 a plan view of the vicinity of the cloth hold-down portion of the automatic sewing machine control apparatus shown in FIG. 7, the cloth hold-down portion being automatically moved.
Figure 11:
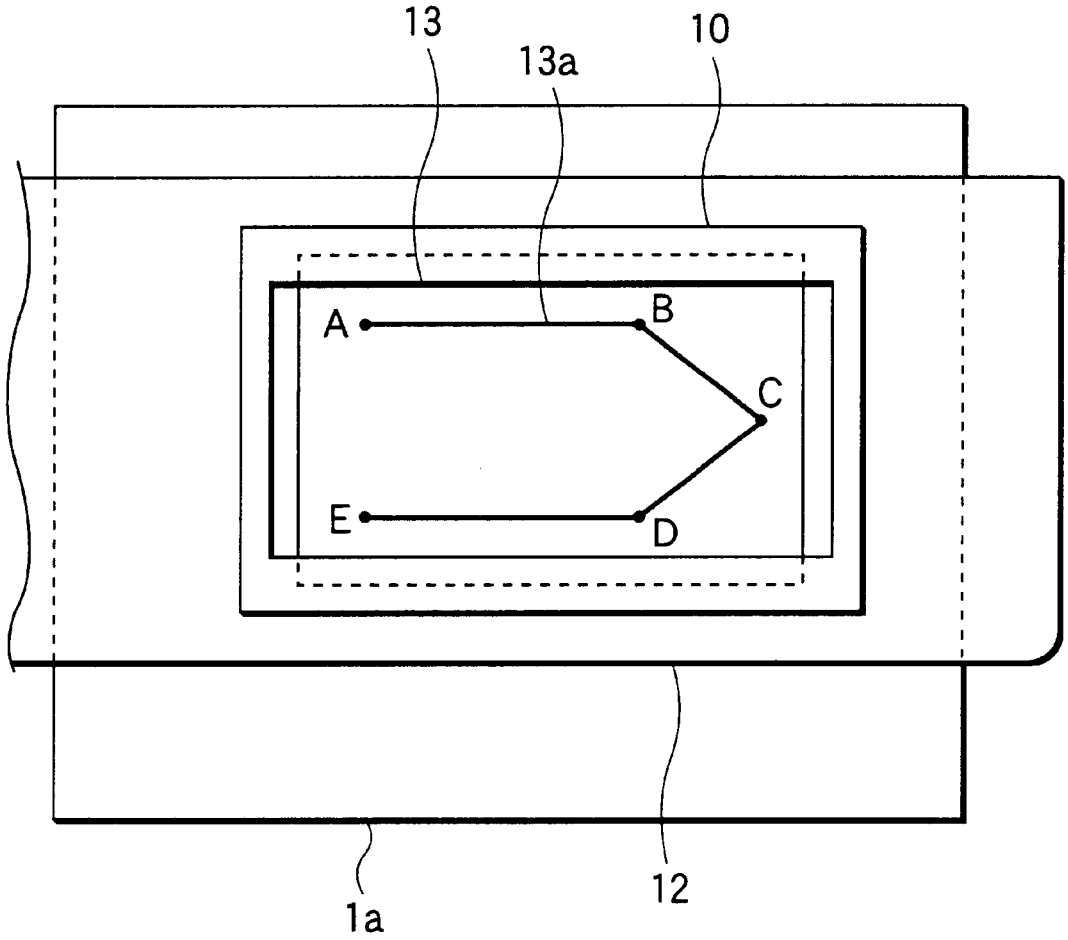
FIG. 11 is a plan view of cloth of FIG. 8 that is sewn to the trouser.

With the automatic sewing machine control apparatus thus arranged, its operation will now be described with reference to FIGS. 1 to 3. When a pocket 13 as a sewing object is sewn to cloth 12 as shown in FIGS. 9 and 11, that is, to attain sewing points A→B→C→D→E after idle feeding from the origin, a start switch 301 is turned on to turn off the driving portion 40 so as to turn on the control portion 30 other than the control portion 40 (Step S101). Then the cloth hold-down portion 10 is manually moved to operate the biaxial driving mechanism 20 to move the machine needle 8 from the origin to the position of the point A (Step S105). At this time, the CPU 32 takes in an output signal via an interface 42 by detecting the rotational angles of X- and Y-axis motors 124 and 126 by using the encoders 224 and 226 (Step S107) whereby the CPU 32 uses the output signal to compute the values of coordinates Xa and Ya at the point A (Step S109). The values of coordinates Xa and Ya thus computed are stored in the RAM 36 (Step S111) as idle data from the origin up to the point A when the 'idle key' and the 'input key' are depressed.

Similarly, the machine needle 8 is moved from the points A to B (Step SI 13) by manually moving the cloth hold-down portion 10 to operate the biaxial driving mechanism 20. The CPU 32 executes the Steps S107 and S109 (Step S115) while using forming means to form linear sewing data on sewing conditions, that is, what has a seaming length of 1.0 mm and stores the data in the RAM 36 (Step S117) when the 'line key', the seam length '1.0' mm, and the 'input key' are depressed.

Further, the biaxial driving mechanism 20 is operated by manually moving the cloth hold-down portion 10 to move the machine needle 8 from the point B over the points C to D and E, and stores the values of coordinates at the points A→B→C→D→E, linear sewing data having a length of 1.0 mm (Step S117) when the 'line key', the seam length '1.0' mm, and the 'input key' are depressed.

Embodiment 2

Figure 4:
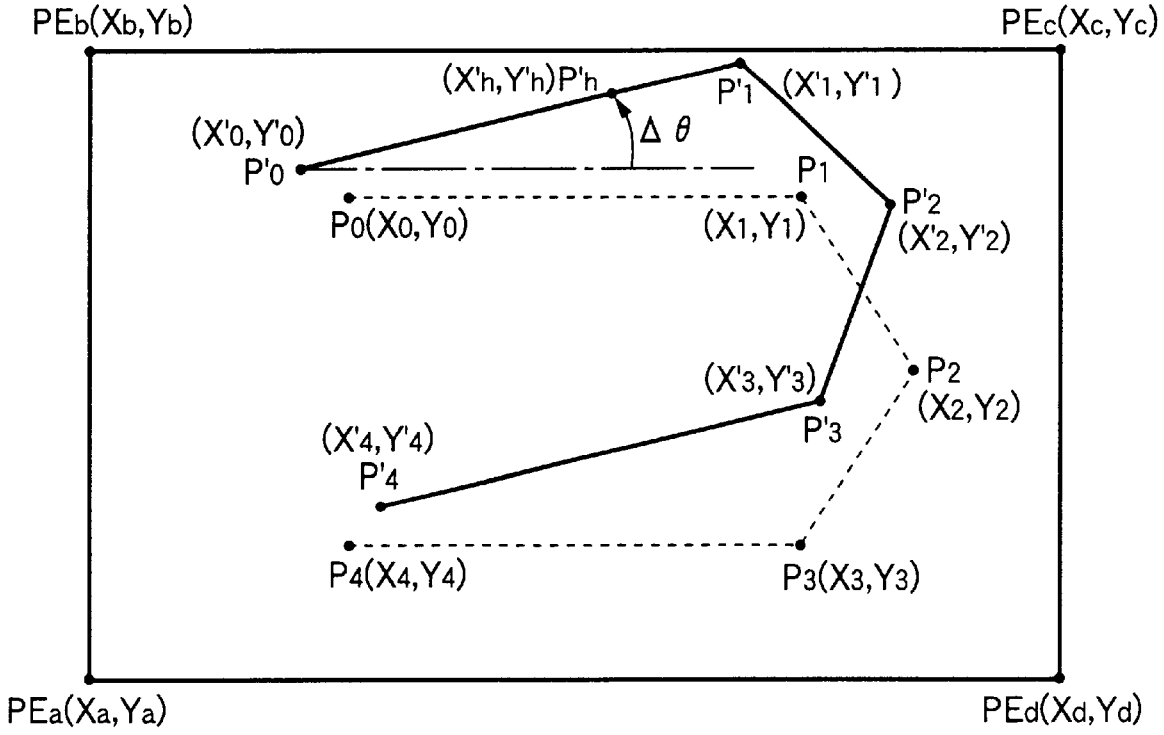
FIG. 4 is a plan view of an article to be sewn as what is exemplifying the invention.
Figure 5:
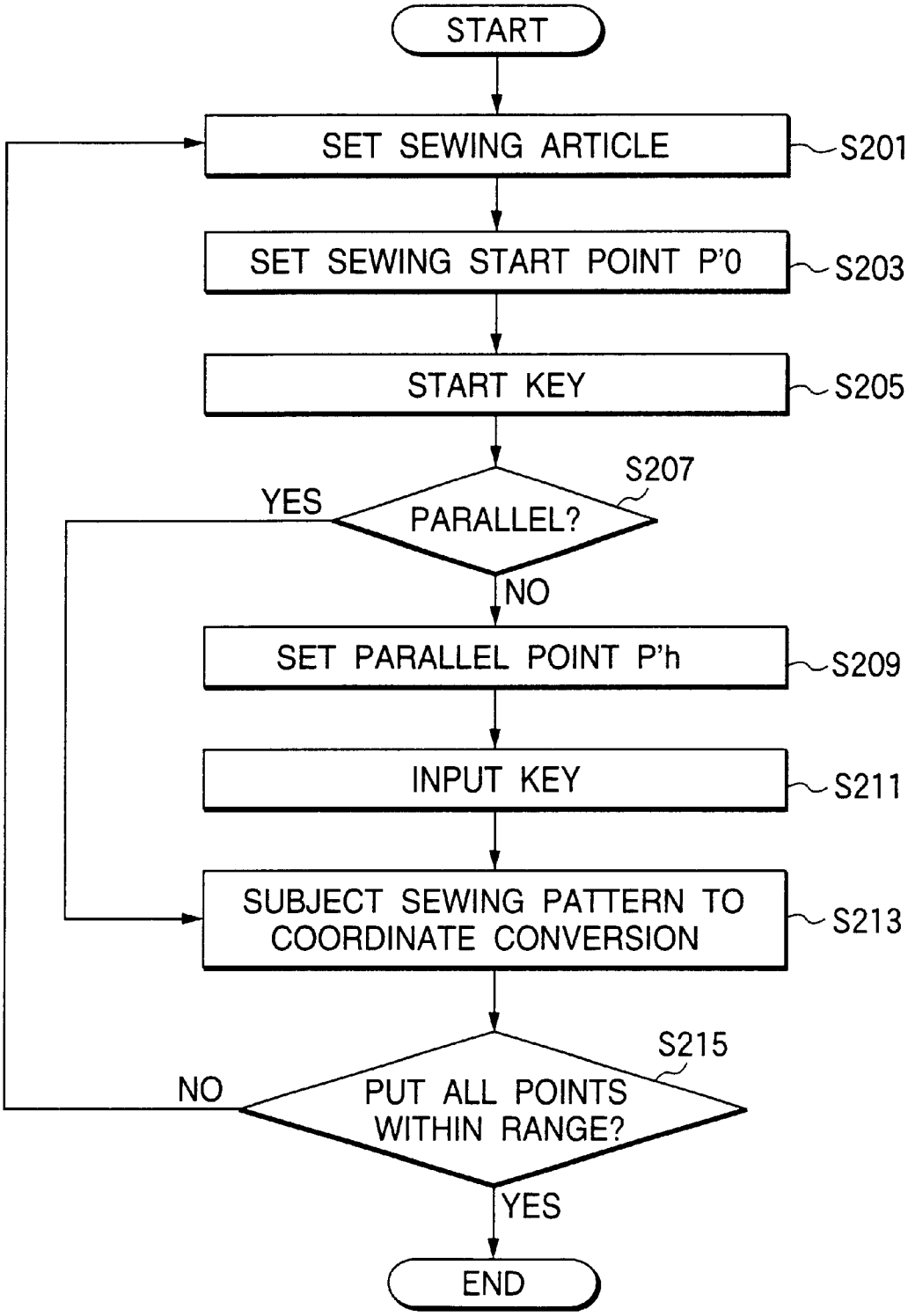
FIG. 5 is a flowchart showing the automatic sewing machine shown in FIG. 4.

Referring to FIGS. 4 and 5, there will be shown another embodiment of the invention, wherein the cloth 13 needs not to be precisely positionally set to the cloth hold-down portion 10 so that the sewing start point can be designated after the cloth 13 is set.

The RAM 36 is designed to store the values of coordinates PEn (Xn and Yn) at each of the points in the area surrounded by, for example, a square PEa→PEb1→PEc→PEd as an area that can be sewn beforehand, and each of the coordinates is stored by inputting a numeric key 52 in the operating portion 50. In this case, the point PEa (Xa and Ya) is taken as a coordinate origin. Further, the RAM 36 is stored with, for example Po (Xo and Yo) and P1 (X1, Y1) as the values of at least two coordinates obtained in the embodiment of the invention.

Now, the cloth 13 has been provided with sewing lines (may be at least two points) with a point P'0 corresponding to the sewing start point and with P0 (X0 and Y0) as the start point of the sewing pattern data stored in the RAM 36. The cloth 13 is then set at the approximate position (Step S201) and a start switch 301 is turned on to turn off the driving portion 40 and the control portion 30 other than the driving portion 40 is turned on (Step S203). The cloth hold-down portion 10 of the biaxial driving mechanism 20 is manually moved whereby to align the sewing start point P'0 to the underside of the machine needle 8. The operator operates to depress the start key (Step S205).

With the CPU 32 using the output signals of the X and Y encoders 224 and 226 as the coordinates P'0 (X'0 and Y'0) of the start point '0, it computes the X'0 and Y'0.

When the operator judges that the sewing article pattern and the cloth 13 are not parallel to each other (Step S207), the operator manually moves the cloth hold-down portion 10 so as to move the machine needle 8 (Step S209) to any given point P'1 on a linear line connecting, for example, the sewing start point P'0 to the next sewing reference point P'1 (Step S209). The operator then depresses the input key (Step S211).

The CPU 32 reads the sewing start point P0 (X0 and Y0) and a sewing curving point P1 (X1 and Y1) as two values of reference coordinates from the RAM 36 so as to obtain the tilting angle θ from the following equation.

$$\tan\theta=(Y1-Y0)/(X1-X0) \quad (1)$$

As the line P0→P1 is parallel thereto as shown in FIG. 4, the tan θ is turned out to be zero.

Because of a point P'h (X'h and Y'h), the CPU 32 then obtains the tilting angle θ' of sewing points of the cloth 13 at P'0→P'1 from the following equation.

$$\tan\theta'=(Y'h-Y'0)/(X'h-X'0) \quad (2)$$

From the angles θ, θ' above, an obtainable angle Δθ of an imaginary reference line obtained from the reference coordinate values of the angles θ and θ' above shifted from the sewing line in the cloth 13 set in the cloth hold-down portion 10 is as follows:

$$\Delta\theta=\theta'-\theta \quad (3)$$

On condition that (n being 0, 1 . . . ) at any given point P, '0, P'1, . . . as P'n (X'n, Y'n), each point is subjected to coordinate conversion (Step S213) using the following equation (4) according to the reference coordinates Xn and Yn at each point stored in the RAM 36 so as to obtain new reference coordinates.

$$X'n=Xx\cdot\cos\Delta\theta+Yy\sin\Delta\theta+X'0 \quad (4)$$

$$Y'n=-Xx\cdot\sin\Delta\theta+Yy\cdot\cos\Delta\theta+X'0 \quad (5)$$

wherein in the equations (4 and 5), Xx=Xn−X0, whereas Yy=Yn−Y0.

The CPU 32 reads the values of the coordinates PEn (Xn and Yn) at each point in the sewable area from the RAM 36 so as to judge whether or not the new sewing reference point P'n (X'n and Y'n) and the passing point are within the sewable area, and also whether or not the P'n subjected to the coordinate conversion and the passing point PEn are within the range enclosed with the PEn (Step S215); if they are within the sewable range, the P'n thus subjected to the coordinate conversion is stored in the RAM 36 and the CPU 32 terminates the operation.

Figure 6:
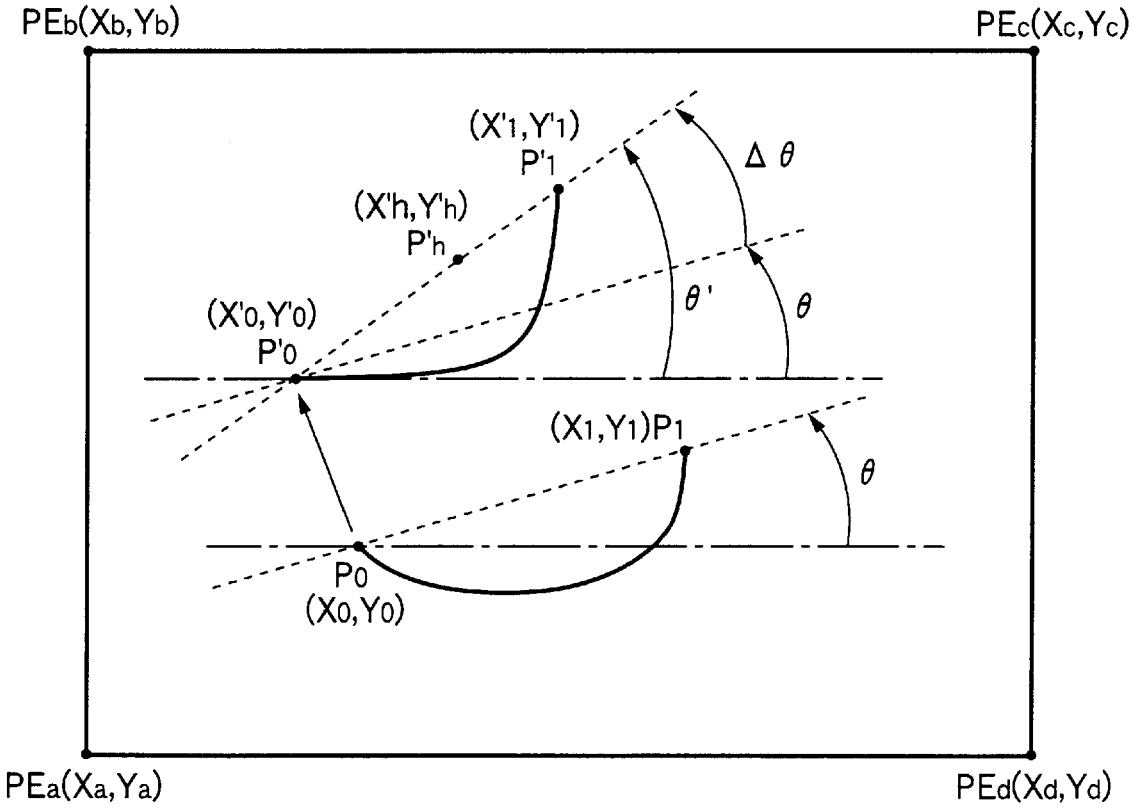
FIG. 6 is a plan view of an article that is clamped by the cloth hold-down portion as what is exemplifying another invention.
Figure 7:
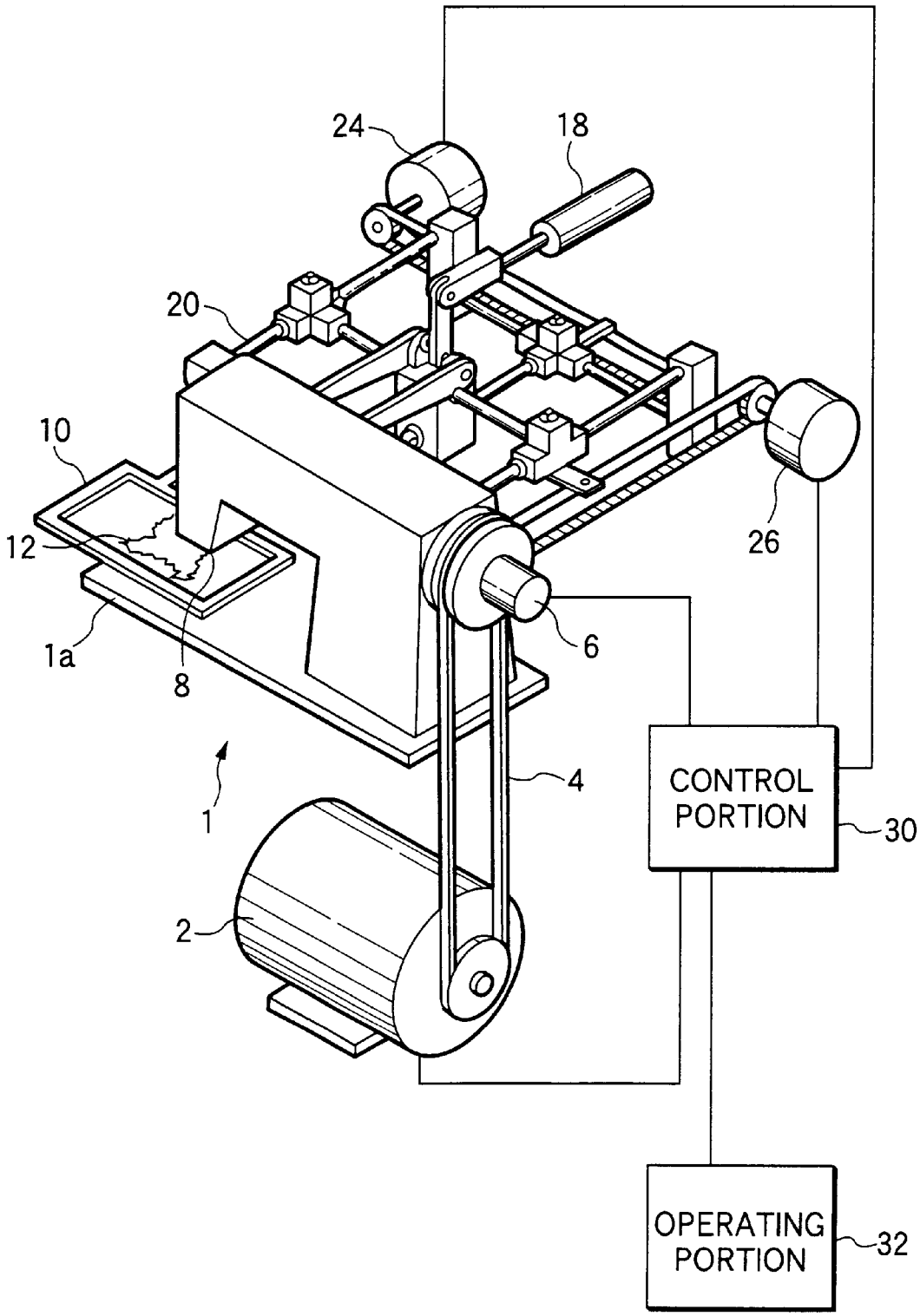
FIG. 7 is a perspective view of the overall automatic sewing machine control apparatus.
Figure 8:
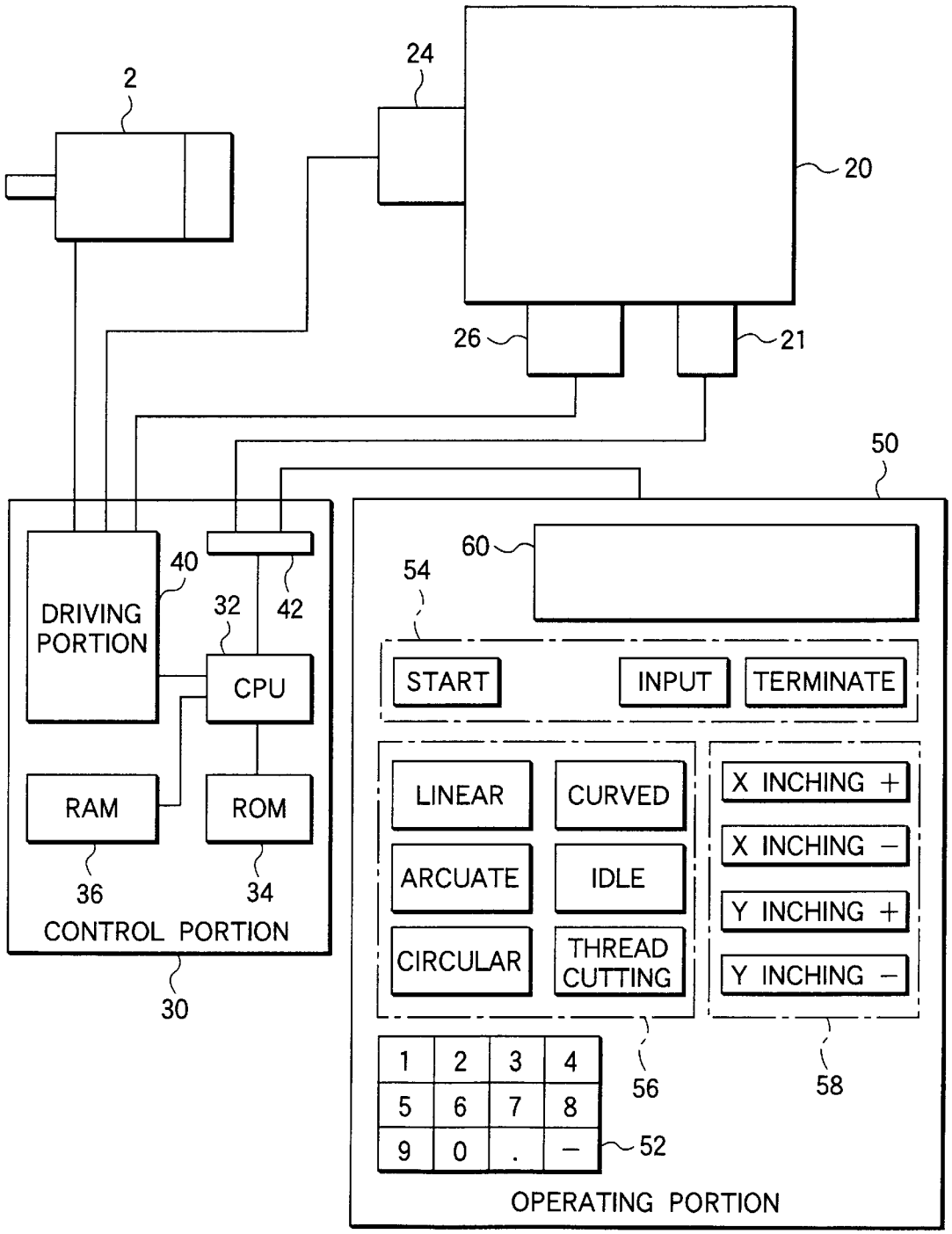
FIG. 8 is a block diagram of an overall conventional automatic sewing machine control apparatus.

Although a description has been given of a linear pattern to be sewn in the embodiment of the invention, the invention is also applicable to a curved pattern as shown in FIG. 6 with the modification of the tilting of the cloth 13 as shown in a flowchart of FIG. 5 through the same procedure.

As set forth above, the invention according to the first aspect of the invention has the effect of easily setting the sewing data at high speed as it is provided with the storage means for storing the X and Y coordinate values obtained by the X and Y coordinate computing means by manually moving the biaxial driving mechanism to at least more than one predetermined position of the machine needle, and forming means for receiving the predetermined position thereof and forming a seam pattern corresponding to the kind of the seam received from the kinds-of-seams inputting means.

Moreover, the invention according to the third aspect of the invention has the effect in addition to what has been mentioned in the second aspect of the invention of easily recognizing whether or not the modified sewing data exits in the sewable range as it is provided with the storage means which has been stored with sewable coordinates showing an area where sewing is possible, and decision means for deciding whether or not each of the modified coordinates of the sewing pattern generated by the modifying means is within the sewable coordinate values.

Industrial Applicability

As set forth above, the automatic sewing machine control apparatus of the invention is suitable to reduce the work of arranging an article to be sewn.

What is claimed is:

1. An automatic sewing machine control apparatus comprising:

kinds-of-seam type inputting means for inputting an idle feed and a seam type such as linear, arcuate, or circular seams corresponding to the seam pattern of an article to be sewn, a cloth hold-down portion for clamping the article, a machine needle which is interlocked with a driving motor for use in sewing the article, a biaxial driving mechanism allowing the cloth hold-down portion to be manually moved in both X- and Y-axis directions perpendicularly intersecting each other, an X- and a Y-axis motor for driving the biaxial driving mechanism, and rotational angle detection means for detecting the rotational angles of the X- and Y-axis motors, X and Y coordinate value computing means for obtaining the values of coordinates X and Y from the origin of the biaxial driving mechanism according to the values detected by the rotational angle detection means, storage means for storing the values of coordinates X and Y obtained by the X and Y coordinate computing means by manually moving the biaxial driving mechanism to at least more than one predetermined position of the machine needle, and forming means for forming a seam pattern corresponding to the seam type received from the seam type inputting means.

* * * * *